United States Patent [19]

Sato

[11] 4,226,060

[45] Oct. 7, 1980

[54] FLOOR PLATE FOR FORMING A FOOT PATH AND METHOD OF LAYING A WALKING SURFACE ON A ROOF

[76] Inventor: Shintaro Sato, 11-8, Yoshiwara 1-chome,, Fuji-city, Shizuoka Prefecture, Japan

[21] Appl. No.: 946,524

[22] Filed: Sep. 26, 1978

[30] Foreign Application Priority Data

Nov. 26, 1977 [JP] Japan ..... 52-141789

[51] Int. Cl.[2] ..... E04B 1/00

[52] U.S. Cl. ..... 52/99; 52/177; 52/747

[58] Field of Search ..... 52/98, 99, 747, 177

[56] References Cited

U.S. PATENT DOCUMENTS 967,542 8/1910 Munro ..... 52/98

*Primary Examiner*—Ernest R. Purser

*Attorney, Agent, or Firm*—Wenderoth, Lind & Ponack

[57] ABSTRACT

Walkable foot plates are laid directly on a concrete slab or a water resistant layer on a roof. Each foot plate has crack inducing grooves which divide the plate into blocks which are connected to each other by weak joint portions defined by the grooves. The foot plate cracks along the grooves to be accommodated to uneven surface portions of the slab or layer. Flexible reinforcing material extends across the weak joint portions to maintain the blocks connected to each other after the weak joint portions are cracked.

5 Claims, 11 Drawing Figures

FIG. 1B
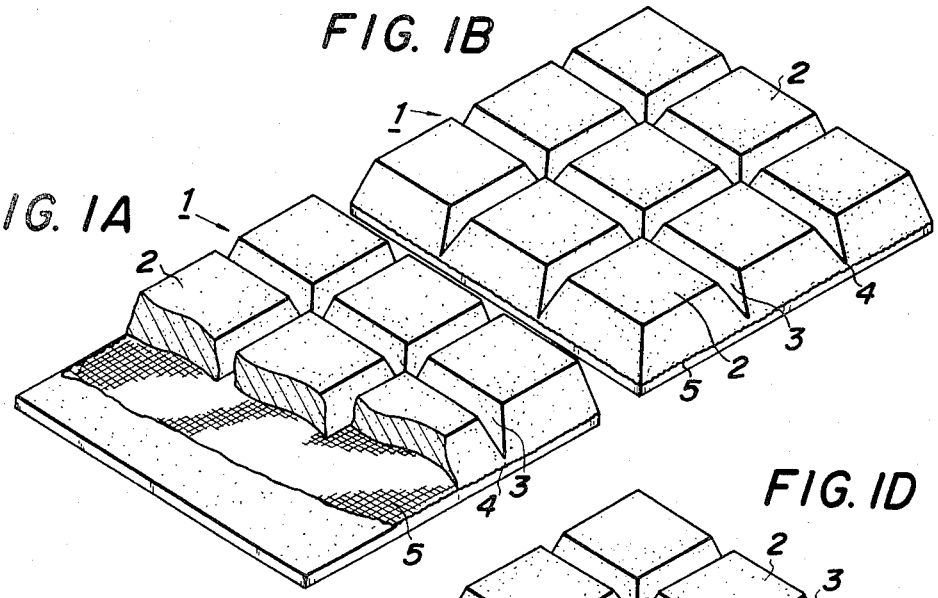
FIG. 1A
FIG. 1D
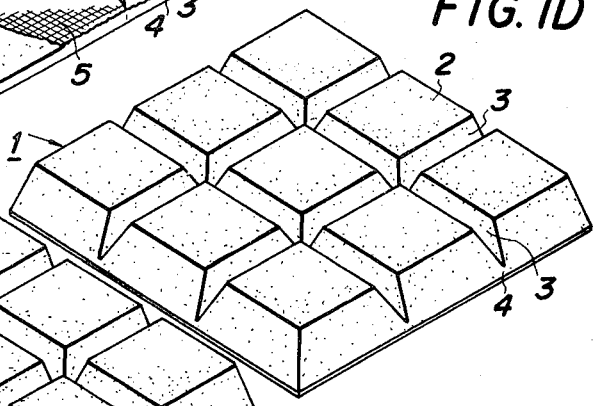
FIG. 1C
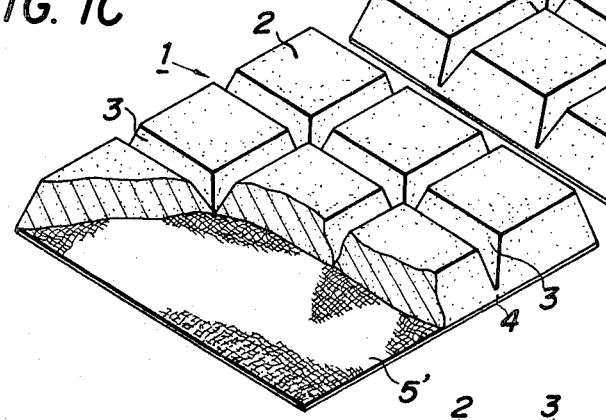
FIG. 2
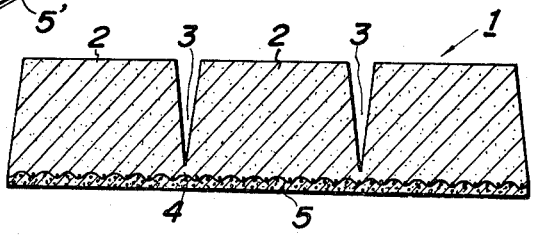
FIG. 3
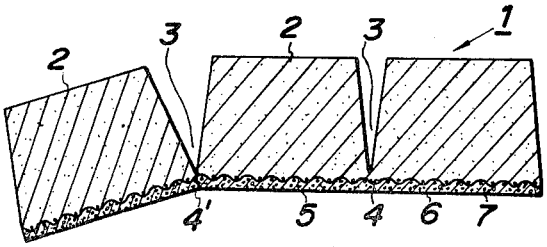

FLOOR PLATE FOR FORMING A FOOT PATH AND METHOD OF LAYING A WALKING SURFACE ON A ROOF

BACKGROUND OF THE INVENTION

The present invention relates to walkable floor plates which are laid on a concrete slab or a water resistant layer on a roof. The present invention also relates to a method of laying such floor plates on a water resistant layer of a roof.

Conventionally, to lay walkable floor plates on a concrete slab or a water resistant layer of a roof, levelling work to compensate for local irregularities of the working surface of the slab or layer must be performed, e.g. by inserting wedges or mortar between the working surface and the floor plates. The levelling work necessitates highly skilled workers. To lay floor plates on a water resistant layer of a roof, mortar is laid on the water resistant layer before the floor plates are laid. As the water resistant layer is completely covered by mortar, it is very difficult to repair and partially replace the water resistant layer when a leak develops therein. Further, it is very difficult to locate such leak after the water resistant layer is covered by mortar.

SUMMARY OF THE INVENTION

The object of the present invention is to provide a floor plate for forming a foot path which can be accommodated to local irregularities of the working surface.

Another object of the present invention is to provide a method of laying walkable floor plates on a water resistant layer of a roof, whereby the floor plates may be cracked into blocks to be accommodated to local irregularities in the surface of the water resistant layer.

The present invention provides a floor plate for forming a foot path and made of brittle material, e.g., mortar having a plurality of crack inducing grooves in at least one side thereof to divide the plate into a plurality of blocks which are connected to each other by weak joint portions which are defined by the crack inducing grooves.

When the foot plates are laid on a working surface, the weak joint portions are easily cracked by a vertical load, due to local irregularities of the working surface, to thus divide the plate into blocks which contact closely with the working surface.

According to another feature of the present invention, flexible reinforcing material extends across the weak joint portions and connects the blocks after the weak joint portions are cracked.

As the blocks are connected to each other by the flexible reinforcing material after the weak joint portions are cracked to accommodate irregularities of the working surface, there is obtained a stable floor plate without separated independent blocks.

According to a feature of the present invention, a method of laying walkable roof plates on a water resistant layer of a roof comprises the steps of laying a plurality of floor plates on a water resistant layer, each plate having a plurality of crack inducing grooves formed in at least one side thereof to divide the plate into a plurality of blocks which are connected to each other by weak joint portions defined by the crack inducing grooves, and cracking the weak joint portions on uneven portions of the water resistant layer to accommodate the blocks to such uneven portions.

The foot plates of the present invention can be laid directly on the water resistant layer without interposing mortar therebetween. The floor plates are divided into blocks by cracking the weak joint portions along the crack inducing grooves so that the blocks closely contact the water resistant layer, even along uneven portions of the water resistant layer. Thus, the need for a levelling process before the floor plates are laid is completely eliminated. Also, locating leaks and repairing the water resistant layer are very easily performed, since the floor plates are only laid directly on the layer and can be removed locally.

Other features and advantages of the embodiments of the invention will become apparent with reference to the following detailed description and attached drawings.

BRIEF DESCRIPTION OF THE DRAWINGS

FIGS. 1A, 1B, 1C and 1D are perspective views of floor plates for forming a foot path according to the invention;

FIG. 2 is a sectional view of the floor plate;

FIG. 3 is a sectional view of the floor plate showing a crack formed between blocks thereof;

DETAILED DESCRIPTION OF PREFERRED EMBODIMENTS

Figure 4:
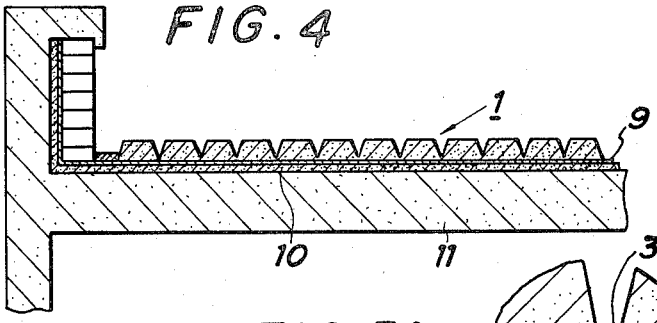
FIG. 4 is a sectional view of floor plates laid on a roof to form a walking surface thereon.

Referring to the drawings, floor plate 1 for forming a foot path according to the present invention is formed of a plate-shaped member of suitable material, e.g., cement. The thickness of the plate 1 is determined according to the particular intended use, e.g., for a walking surface on a roof, or for other floor surfaces. Many floor plates 1 are arranged to form a desired floor. On the upper surface of the floor plate 1 are formed a plurality of longitudinal and lateral crack inducing grooves 3 which together form a group of square blocks 2. The blocks may be of other polygonal shapes such as triangles or hexagons. The crack inducing grooves 3 may be preferably formed as small angled V-shaped grooves. By the grooves 3, weak joint portions 4 are formed between the blocks 2. The thickness of the grooves 3 for a plate 1 formed of mortar and of 50–100 mm thickness may be selected to be more than 70% of the thickness of the plate.

The weak joint portions 4 connect the blocks 2 to each other so that the floor plate 1 can be handled as an integral plate during storing and transportation. When the plate 1 is placed on a concrete slab or a water resistant layer of a roof, and when a vertical load is applied to the plate, the weak joint portions 4 are cracked to cause cracks 4' (see FIGS. 3 and 5B) when the slab or layer is not perfectly plane. Therefore, the divided blocks 2 are accommodated to any irregularities in the surface of the slab or water resistant layer. Flexible reinforcing material is inserted or included within the plate to span all of the weak joint portions 4. The flexible material may preferably be wire netting 5 shown in FIG. 1A or nonwoven fabric 5' shown in FIG. 1C. The flexible material can also be plastic sheet, woven fabric, glass fibers, or metal or plastic strands or net. The flexible material may be inserted as one or more layers, may be scattered as short fibers in the plate, or may be laid on or near the bottom of the plate. Thus, the blocks 2 are not separated from each other after the weak joint portions are cracked, but remain connected to each other by the flexible material 5.

The floor plate 1 may preferably be formed by mortar, but many known aggregates, e.g., pulp slash, waste mold gypsum, bauxite or slag may be used alone or may be added to sand. The floor plate 1 may be formed by a plurality of layers. FIGS. 3 and 5B show a layer 6 containing a foamable plastic aggregate 7, which is formed as a bottom layer to further weaken the weak joint portions 4, and also the plate 1 is of light weight and is heat resistant. The bottom layer 6 may be formed by other material, e.g., polyvinyl chloride or rubber asphalt, or may contain porous material, e.g., slag or vermiculite.

Figure 5:
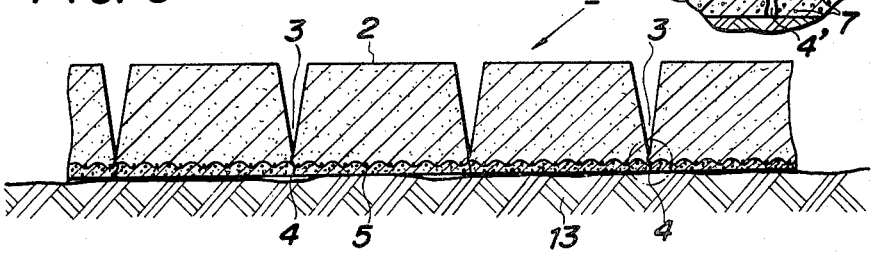
FIG. 5 is a sectional view of floor plates laid to form a foot path.
Figure 6:
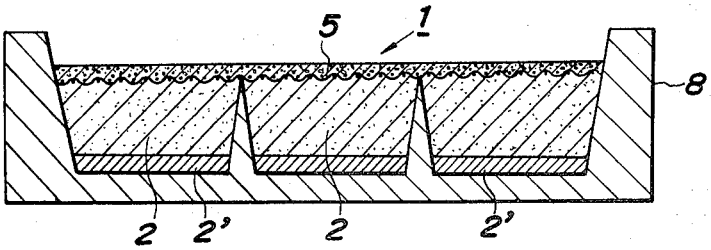
FIG. 6 is a sectional view of a mould used to form the floor plates.
Figure 7:
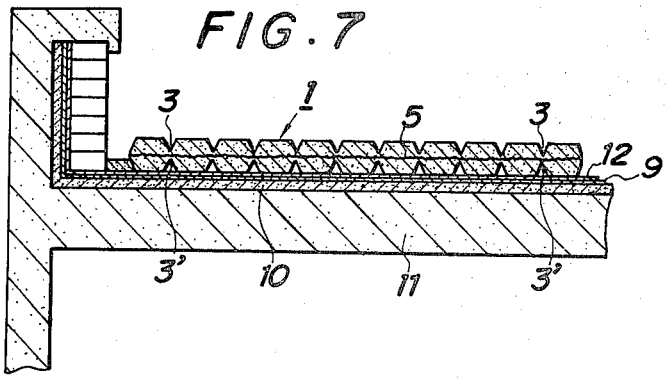
FIG. 7 is a sectional view of another embodiment of floor plates laid on a roof.

As shown in FIG. 6, a mould 8 has projections 8' corresponding to crack inducing grooves 3. In the mould 8, suitable material, e.g., mortar is poured. Then, flexible material 5, e.g., nonwoven fabric is laid thereon, and mortar containing foamable plastic 7 is poured thereinto. Tiles 2' or other decorative plates may be first positioned at the bottom of the mould. After the mortar is cured, the finished plate 1 can be removed from the mould 8. The plates 1 are readily transported to a building site or desired place and are used to form a floor surface, as shown in FIG. 5, or a roof surface, as shown in FIGS. 4 and 7.

Figure 5A:
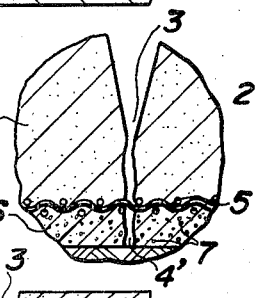
FIG. 5A is an enlarged detail view of that portion of the plate which is encircled in FIG. 5.

As shown in FIG. 5A, many floor plates 1 are arranged on concrete slab 13. When a vertical load is applied on the blocks 2, some blocks 2 are separated from adjacent blocks by cracking of weak joint portions 4 along the crack inducing grooves 3 due to irregularities in the surface of the slab 13. Thus, the blocks 2 are connected with the adjacent blocks by the flexible material 5 and all blocks 2 closely contact the upper surface of the slab 13. Consequently, without inserting mortar or wedges between the floor plates 1 and the slab 13, a generally horizontal floor surface which will not rattle can be very easily formed. Conventional high grade levelling work which necessitates highly skilled workers is not necessary. It is only necessary that the floor plates 1 be arranged directly on a concrete slab or a roughly levelled surface. Working efficiency is improved and time and cost are greatly decreased. Especially, for a sidewalk or promenade, the floor plates 1 can be placed on a roughly levelled surface. As shown clearly in the drawings, the floor plate 1 is formed as a plurality of tiles or blocks 2 which are connected to each other. Thus, it is not necessary to arrange or place each tile or block 2 by hand.

As shown in FIG. 4, a walking surface on a roof can be made merely by placing the floor plates 1 directly on a water resistant layer 9 of the roof. A vertical load on the blocks 2 induces cracks at the weak joint portions 4 and the blocks 2 are thus accommodated to irregularities in the surface of the water resistant layer 9 and closely contact the layer 9. Generally, a mortar layer 10 is laid on a roof slab 11 and the water resistant layer 9 is laid on layer 10. Further, a protective sheet 12 made of a web or a plastic sheet may be laid on layer 9 before the floor plates 1 are placed thereon to protect the water resistant layer 9, as shown in FIG. 7.

It will be appreciated that the floor plates 1 according to the invention can be formed into a floor surface merely by placing the plates 1 on a surface having some irregularities. The blocks 2 are accommodated to the surface by cracking at the weak joint portions 4. When the floor plates 1 are used as a walking surface on a roof, a water resistant layer can be easily repaired by simply removing the necessary floor plate 1, since no mortar layer is provided between the water resistant layer 9 and the floor plates 1. High precision levelling of the surface before the floor plates 1 are laid is not necessary. As the blocks 2 are accommodated to the irregularities of the working surface, a floor surface which will not rattle can be easily obtained.

As shown in FIG. 7, the floor plate 1 may be formed with another group of crack inducing grooves 3' at rear or bottom surface of the plate 1. Weak joint portions 4 are formed between the crack inducing grooves 3 and 3', and flexible reinforcing material 5 is inserted in the plate 1 to extend through the weak joint portions 4. The weak joint portions 4 are more easily cracked. The rear or bottom side grooves 3' act as water passages when the floor plates 1 are laid on an open air surface such as a roof surface.

We claim:

1. A floor plate for use in forming a floor surface, said floor plate comprising:

a plate-shaped member formed of a brittle material such as concrete, said member having spaced parallel first and second major surfaces;

said member having formed in at least said first major surface thereof a plurality of crack inducing grooves dividing said member into a plurality of blocks which are connected to each other by weak joint portions defined between the bottoms of said crack inducing grooves and said second major surface, said weak joint portions having a thickness and strength to allow cracking therealong when said member is placed on a support layer having surface irregularities and when a load is applied thereto; and said member having incorporated therein means for maintaining said blocks flexibly connected to each other after said cracking, said means comprising flexible reinforcing material extending through said member at a position between said second major surface and said bottoms of said grooves, said material spanning all of said weak joint portions.

2. A plate as claimed in claim 1, wherein both said first and second major surfaces have formed therein said crack inducing grooves.

3. A method of forming a floor surface, said method comprising:

providing a plurality of floor plates, each comprising a plate-shaped member formed of a brittle material such as concrete, said member having spaced parallel first and second major surfaces, said member having formed in at least said first major surface thereof a plurality of crack inducing grooves dividing said member into a plurality of blocks connected to each other by weak joint portions defined between the bottoms of said grooves and said second major surface, and said member having incorporated therein flexible reinforcing material extending through said member at a position between said second major surface and said bottoms of said grooves, said material spanning all of said weak joint portions;

loosely positioning said plurality of floor plates on a support layer having therein surface irregularities, with said second major surfaces contacting said support layer, thereby forming a floor surface, without interposing mortar between said floor plates and said support layer; and applying a load to said first major surfaces of said plates, thereby causing said plates to crack entirely through said weak joint portions, and thus causing said blocks to individually conform to said surface irregularities of said support layer, while maintaining said blocks flexibly connected to each other by said flexible reinforcing material.

4. A method as claimed in claim 3, wherein said support layer comprises a water resistant layer of a roof.

5. A method as claimed in claim 4, comprising providing said member with said grooves formed in both said first and second major surfaces thereof.

* * * * *